US005273120A

United States Patent [19]

Chang

[11] Patent Number: 5,273,120

[45] Date of Patent: Dec. 28, 1993

[54] POWER TOOL WITH A VIBRATION ABSORBING HANDLE

[75] Inventor: Ted C. Chang, Roanoke, Va.

[73] Assignee: Ingersoll-Rand Company, N.J.

[21] Appl. No.: 67,779

[22] Filed: May 26, 1993

[51] Int. Cl.[5] ..... B25G 1/00

[52] U.S. Cl. ..... 173/162.2; 16/116 R

[58] Field of Search ..... 173/162.2, 162.1; 16/116 R

[56] References Cited

U.S. PATENT DOCUMENTS

| | | | |
|---|---|---|---|
| 786,050 | 3/1905 | Richwood . | |
| 2,134,863 | 11/1938 | Dvorak . | |
| 2,830,463 | 4/1958 | Ircens . | |
| 2,831,463 | 4/1958 | Ekström et al. | 173/162.2 |
| 4,368,556 | 1/1983 | Wanner et al. | 173/162.2 |
| 4,648,468 | 3/1987 | Honsa . | |
| 4,896,426 | 1/1990 | Nagashima | 173/162.2 |
| 4,949,457 | 8/1990 | Burout, III . | |
| 5,038,480 | 8/1991 | Naslund | 173/162.2 |
| 5,052,500 | 10/1991 | Ohtsu | 173/162.2 |
| 5,054,562 | 10/1991 | Honsa et al. . | |
| 5,157,807 | 10/1992 | Keller et al. | 173/162.2 |

FOREIGN PATENT DOCUMENTS

| | | |
|---|---|---|
| 490850 | 6/1992 | European Pat. Off. . |
| 55630 | 5/1967 | Fed. Rep. of Germany . |

*Primary Examiner*—Scott Smith

*Attorney, Agent, or Firm*—John J. Selko

[57] ABSTRACT

A vibration absorbing handle on a percussive-actuated tool, the handle being covered in a monolithic, vibration absorbing material, and including a flexible member in a bore of the handle, the handle being positioned against an angle surface on a tool housing to rock back and forth over the apex of the angled surface in response to pressure from an operator.

7 Claims, 2 Drawing Sheets

POWER TOOL WITH A VIBRATION ABSORBING HANDLE

BACKGROUND OF THE INVENTION

This invention relates generally to power tools, and more particularly to percussive operated power tools, such as paving breakers, in which handles are designed to absorb operational vibrations and shocks. When a hand held paving breaker is in operation, part of the energy created by the piston transfers back through the moil and the housing to the operators's arm. This causes operator fatigue and reduces productivity.

Prior art vibration absorbing handles are flexible to a small degree in both the upward direction and in the downward direction. When a moil becomes stuck and the operator pulls upwardly to dislodge it, the upward flexibility of the handle works against the operator's pulling force.

The foregoing illustrates limitations known to exist in present tools having vibration absorbing handles. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a vibration absorbing handle for a power tool having an elongated handle housing with a longitudinal axis of symmetry, a first end; a bore coaxial with the axis, the bore forming an opening at the first end and extending into the handle housing; a support member connected to a portion of the tool housing, the support member coaxial with the axis and extending into the bore; a hollow, tubular, elastic flex member in the bore, coaxial with the axis, the flex member telescoped over the support member and extending in the bore, the flex member affixed to the handle housing and to the support member; and the handle housing contacting the tool housing at an angled surface on the tool housing, the surface having an angle with an outwardly extending apex positioned at the axis, whereby the handle can rock back and forth over the apex, when the flex member is flexed.

The foregoing and other aspects will become apparent from the following detailed description of the invention when considered in conjunction with the accompanying drawing figures.

BRIEF DESCRIPTION OF THE DRAWING FIGURES

FIG. 1 is a schematic, front elevational view, in partial cross section, with parts removed, of a paving breaker of the invention; and FIG. 2 is view similar to FIG. 1 wherein the handle is shown flexed into a downward position.

DETAILED DESCRIPTION

Figure 1:
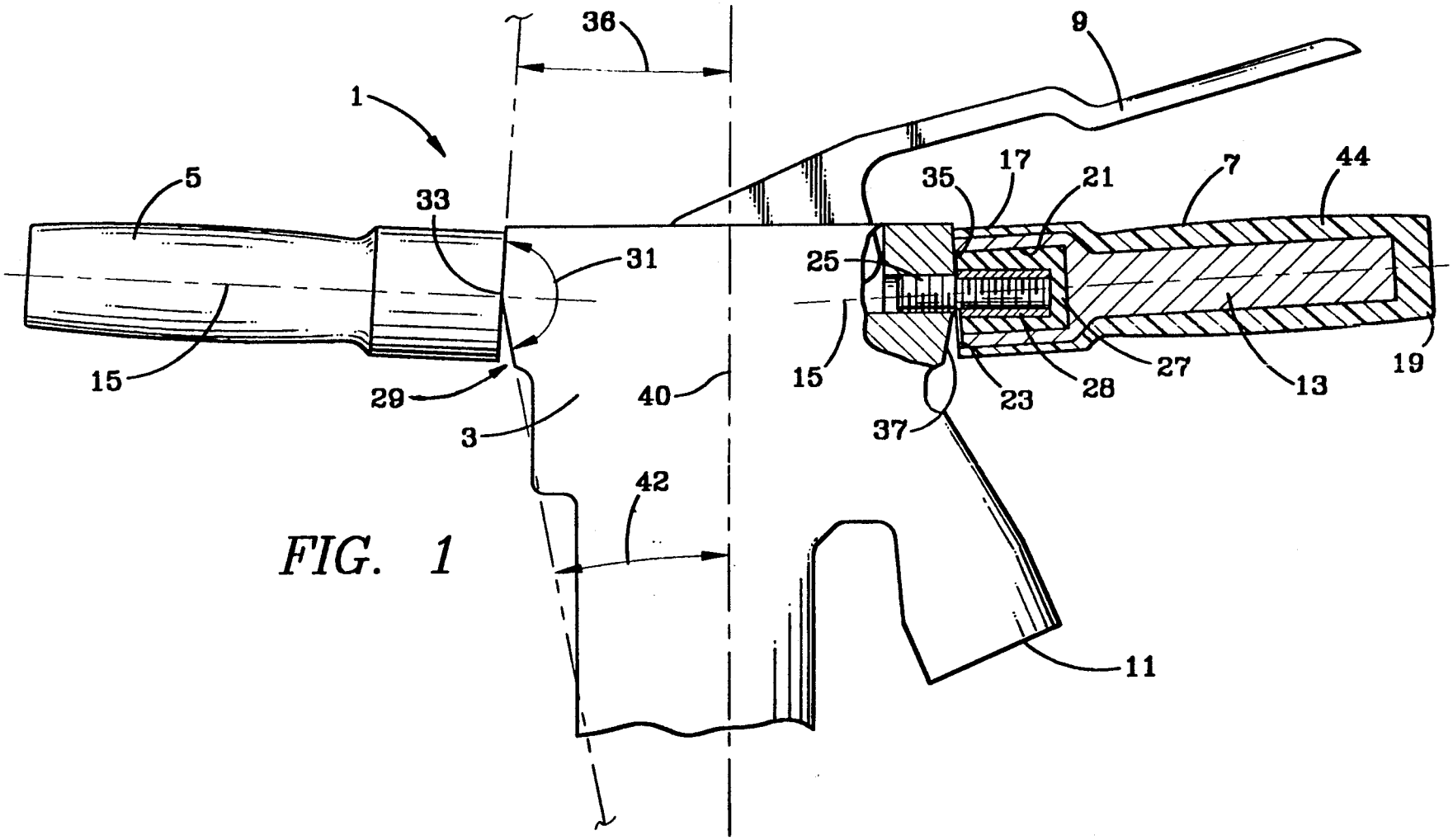
Figure 2:
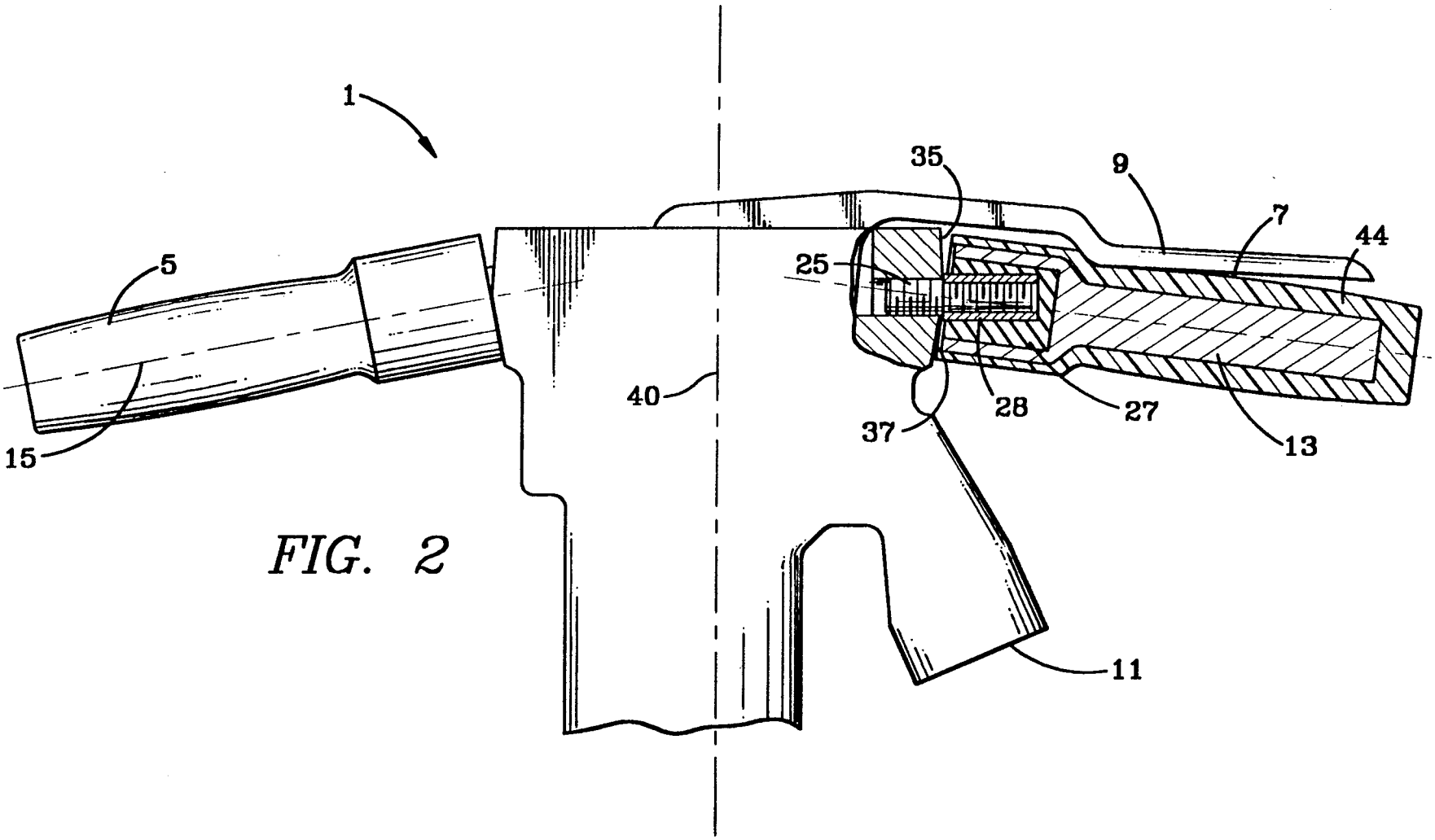

Referring to the FIG. 1, there is shown the fluid-actuated paving beaker 1, having a housing 3 which includes any well-known combination of parts not shown: reciprocal piston, fluid passageways and apertures to operate the piston, fluid entry ports to supply percussive fluid, exhaust passageways to exhaust the percussive fluid, and chuck means for retaining a moil in the front end of the housing 3. The details of the operational features are not shown, as they are not part of the invention, so long as the device is operational.

Connected to the top end of housing 3 is a pair of oppositely positioned handles 5 and 7, each handle being identical, so a description of one will suffice for both. A pivotable operator's lever 9 is associated with one of the handles 7 and is pressed downwardly by the palm of an operator to actuate the device, as is well known. A conventional air inlet 11 is also shown schematically.

A vibration absorbing handle 7 includes an elongated handle housing 13 having a longitudinal axis of symmetry 15, a first end 17, a second end 19, and a bore 21 coaxial with axis 15. Bore 21 forms an opening 23 at first end 17 and extends into handle housing 13. A support member 25 is connected to a portion of tool housing 3. Support member 25 is coaxial with axis 15 and extends into bore 21.

A hollow, tubular, elastic flex member 27 in bore 21, is coaxial with axis 15. Flex member 27 has affixed therein a hollow, tubular bushing 28, coaxial with axis 15. Bushing 28 has a bore therethrough and is threaded on the surface forming the bore. Flex member 27 and bushing 28 are telescoped over support member 25 and extend in bore 21. Flex member 27 is permanently affixed to handle housing 13 and threadably affixed to support member 25 via bushing 28. Flex member 27 provides elasticity for flexibility, and bushing 28 provides strength for connection to support member 25.

Handle housing 13 contacts tool housing 3 at an angled surface 29 on tool housing 3. Angled surface 29 has an angle 31 with an outwardly extending apex 33 positioned at axis 15, whereby handle housing 13 can rock back and forth over apex 33, when flex member 27 is flexed. I prefer angle 31 to be about 170 degrees.

As seen in FIG. 1, angled surface 29 is formed, preferably, by two intersecting planes. Upper plane 35 is oriented to face toward a top end of housing 3, and lower plane 37 is oriented to face toward a lower end of housing 3, with both planes intersecting at apex 33. A gently curving surface be equivalent.

Support member 25 is a pin threadably connected to housing 3 coaxially along axis 15. When handle 7 is not being pressed downwardly by an operator, it is in contact with upper plane 35 and not lower plane 37. As seen in FIG. 1, upper plane 35 forms an angle 36 with longitudinal axis of symmetry 40 of tool housing 3. Lower plane 37 forms an angle 42 with tool housing axis 40. I prefer angle 36 to be about 2 degrees, and angle 42 to be about 8 degrees.

With upper and lower planes, 35, 37 positioned thusly, upper plane 35 provides a "stop" against which handle 7 is positioned when the operator releases downward pressure, such as when the device is not being operated, or when the operator wishes to exert upward pressure, to release a stuck moil. Lower plane 37 provides a "stop" against which handle 7 is positioned when the operator applies sufficient downward force. Thus, it can be understood that handle 7 is flexible in the downward, direction, but does not work against the drill operator's upward pulling force. Also, by reason of the universal flexibility of flex member 27, even when the handle 7 is contacting the "stop" of upper plane 35 or the "stop" of lower plane 37, the handle can be flexed in other directions than up or down, respectively, so it still can absorb some amount of vibrations.

Housing 13 is completely encased in a monolithic coating 44 of suitable elastomeric material, such as rubber, to absorb vibrations. I prefer to provide handle 7 as a unified part in which the flex member 27 is permanently affixed in housing 13, with bushing 28 permanently affixed to flex member 27, and the total combination molded in coating 44. I prefer flex member 27 to be provided from neoprene material.

Having described the invention, what is claimed is:

1. A vibration absorbing handle for a power tool comprising:

(a) an elongated handle housing having a longitudinal axis of symmetry, a first end, a second end, a bore coaxial with said axis, said bore forming an opening at said first end and extending into said handle housing;

(b) a support member connected to a portion of said tool housing, said support member coaxial with said axis and extending into said bore;

(c) a hollow, tubular, elastic flex member in said bore, coaxial with said axis, said flex member telescoped over said support member and extending in said bore, said flex member affixed to said handle housing and to said support member; and (d) said handle housing contacting said tool housing at an angled surface on said tool housing, said surface having an angle with an outwardly extending apex positioned at said axis, whereby said handle can rock back and forth over said apex, when said flex member is flexed.

2. The handle of claim 1 in which said flex member has affixed therein a hollow, tubular bushing, coaxial with said axis.

3. The handle of claim 2 in which said handle housing is covered with an elastic, vibration absorbing coating.

4. The handle of claim 3 in which said flex member is made from neoprene material.

5. A percussion operated power tool having vibration absorbing handles thereon comprising:

(a) a tool housing; and (b) a pair of oppositely positioned, outwardly extending handles affixed to said housing, each handle comprising:

(i) an elongated handle housing having a longitudinal axis of symmetry, a first end, a second end, and a bore coaxial with said axis, said bore forming an opening at said first end and extending into said handle housing;

(ii) a support member connected to a portion of said tool housing, said support member coaxial with said axis and extending into said bore;

(iii) a hollow, tubular, elastic flex member in said bore, coaxial with said axis, said flex member telescoped over said support member, said flex member affixed to said handle housing and to said support member; and (iv) said handle housing contacting said tool housing at an angled surface on said tool housing, said surface having an angle with an outwardly extending apex positioned at said axis, whereby said handle housing can rock back and forth over said apex, when said flex member is flexed.

6. The tool of claim 5 wherein each handle housing is covered with an elastic, vibration absorbing material.

7. The tool of claim 6 in which said flex member is made from neoprene material.

* * * * *